US005465948A

United States Patent [19]

Weller

[11] Patent Number: 5,465,948

[45] Date of Patent: Nov. 14, 1995

[54] SHEET FEEDING AND SEPARATING APPARATUS

[75] Inventor: Richard G. Weller, Webster, N.Y.

[73] Assignee: Xerox Corporation, Stamford, Conn.

[21] Appl. No.: 125,725

[22] Filed: Sep. 23, 1993

[51] Int. Cl.[6] ..... B65H 3/04; B65H 3/52

[52] U.S. Cl. ..... 271/34; 271/121

[58] Field of Search ..... 271/34, 35, 121, 271/122

[56] References Cited

U.S. PATENT DOCUMENTS

| | | | |
|---|---|---|---|
| 1,058,314 | 4/1913 | Lynch | 271/34 |
| 3,847,385 | 11/1974 | Wieloch | 271/121 |
| 4,113,245 | 9/1978 | Colglazier et al. | 271/121 X |
| 4,213,603 | 7/1980 | Peffer et al. | 271/229 |
| 4,284,269 | 8/1981 | Ignatjev | 271/122 |
| 4,494,744 | 1/1985 | Povio et al. | 271/34 |
| 4,928,127 | 5/1990 | Stemmle | 346/160 |
| 5,014,976 | 5/1991 | Muck et al. | 271/220 |
| 5,029,839 | 7/1991 | Kajiwara et al. | 271/122 X |
| 5,192,068 | 3/1993 | Parker et al. | 271/34 |

FOREIGN PATENT DOCUMENTS

| | | | |
|---|---|---|---|
| 3508270 | 9/1986 | Germany | 271/121 |
| 35716 | 3/1980 | Japan | 271/122 |
| 104842 | 6/1983 | Japan | 271/34 |
| 93049 | 5/1985 | Japan | 271/35 |
| 178133 | 7/1990 | Japan | 271/121 |
| 98931 | 4/1991 | Japan | 271/122 |

OTHER PUBLICATIONS

Diel et al., "Self-Adjusting Throat Guide", Dec.- 1971 IBM Tech. Disclosure Bull., vol. 14, No. 7, p. 2240.

*Primary Examiner*—William E. Terrell
*Assistant Examiner*—Luong Nguyen
*Attorney, Agent, or Firm*—H. Fleischer; J. E. Beck; R. Zibelli

[57] ABSTRACT

An apparatus which separates and advances successive individual sheets from a stack of sheets. The stack of sheets is supported on a tray which moves in upwardly direction to position the uppermost sheet in engagement with an endless belt. The endless belt moves in a recirculating path to advance successive sheets from the stack. A retard roller engages the endless belt to define a nip for separating any overlapped sheets. Interposed between the retard roller and the tray is a stationary guide member. As the sheet advances toward the nip from the stack, it engages the guide member and is guided toward the nip. A thin, flexible member has one end secured to the guide member. The other end of the flexible member is free and extends into the nip. The flexible member is interposed between the belt and the retard roller with the sheet passing between the belt and the flexible member into the nip. In this way, the thin, flexible member guides the sheet into the nip, and, simultaneously, shields the sheet from the retard roll reducing friction on the sheet as it advances into the nip.

4 Claims, 3 Drawing Sheets

SHEET FEEDING AND SEPARATING APPARATUS

This invention relates generally to a sheet feeding an registration apparatus, and more particularly concerns guiding the sheet into a registration nip.

In modern electrophotographic printing machines such as printers and copiers/duplicators, it is necessary to deliver individual sheets in seriatim to a processing station at which the sheets are registered and a function performed thereon. For example, the sheets may be advanced to a transfer station where a developed image on a photoconductive drum or belt is transferred to the sheet. Alternatively, the sheet, i.e. an original document, may be advanced to a platen for exposure of the photoconductive member. In either case, registration of the sheet is a critical parameter. Only by appropriately registering the sheet can the developed image be appropriately transferred to the sheet or the information on the original document recorded on the photoconductive member. The sheet feeders must be capable of handling a wide variety of these sheets without misfeeds or multi feeds or multi feeds. However, most sheet feeding devices are designed specifically for a particular type or weight of sheet or range of weights of sheets upon which the copies are to made, or original documents which are fed to the platen. In practice, it has been found that the sheet feeding devices are required to feed sheets of a wider variety of characteristics than had been anticipated. In most sheet feeding devices of the type hereinbefore utilized, sheet jams or multi feeds frequently occur. The sheet may curl downwardly or upwardly and not reach the nip defined for feeding the sheets. This causes a jam in the printing machine. Alternatively, light weight sheets may buckle and curl. Feeding of downwardly curled sheet is a particular problem in that the sheet has a tendency to stub against the entrance guide and then misfeed or become nicked. In the case of a buckling sheet, the sheet is mutilated and is not properly registered.

The following disclosures may be relevant to various aspects of the present invention:

- U.S. Pat. No. 4,213,603 Patentee: Peffer et al. Issued: Jul. 22, 1980
- U.S. Pat. No. 4,494,744 Patentee: Povio et al. Issued: Jan. 22, 1985
- U.S. Pat. No. 4,928,127 Patentee: Stemmle Issued: May 22, 1990
- U.S. Pat. No. 5,014,976 Patentee: Muck et al. Issued: May 14, 1991
- U.S. Pat. No. 5,192,068 Patentee: Parker et al. Issued; Mar. 9, 1993

The relevant portions of the foregoing disclosures may be briefly summarized as follows:

U.S. Pat. No. 4,213,603 describes a recirculating document feeder having a transport and registration mechanism for advancing documents across the platen. The documents are stopped and registered at a registration position on the platen for copying. A registration gate engages a flexible strip. During registration the gate moves downwardly pushing the flexible strip into the sheet path. The flexible strip or sheet extends over a portion of the lead marginal region or edge of the sheet. These flexible strips form an optical mask for the openings required by the registration gates.

U.S. Pat. No. 4,494,744 discloses a sheet feeder having a multi piece entrance guide located between a stack from which sheets are fed and a retard nip. The guide includes a polycarbonate base with a high friction urethane retard member. The entrance guides the lead edge of the sheet into a nip defined by an endless belt and retard roll.

U.S. Pat. No. 4,928,127 discloses a sheet feeder having fingers provided over the open or exposed front portion of the top of a cassette tray extending between the feed wheels of the sheet feeder as an extension of the cover in the area where the cover does not extend. This prevents sheets being duplexed from catching on corner snubbers.

U.S. Pat. No. 5,014,976 describes exit rollers for a tray. Previously outputted and stacked copy sheets are prevented from being recaptured by the reverse rotation exit rollers by automatically interposing a deflectable portion of a trap in the nip defined by the rollers. The deflectable portion is automatically deflected out of the way of a sheet being outputted from the nip of the exit rollers by the force of the sheet itself.

U.S. Pat. No. 5,192,068 describes a sheet feeding and separating apparatus having a multiple piece entrance guide located between a stack of sheets and a retard nip. The guide includes a polycarbonate base and urethane retard member. A flexible polycarbonate or polyester film deflector extends upwardly into the sheet path and has one end portion thereof secured to the guide. The deflector assists in feeding downwardly curled sheets.

In accordance with one aspect of the present invention, there is provided an apparatus for separating an advancing sheet from a stack of sheets. The apparatus includes a tray for supporting the stack of sheets. An endless belt is mounted in engagement with a sheet of the stack of sheets to advance the sheet from the stack of sheets. A retard member engages the endless belt to define a nip therebetween for separating any overlapped sheets reaching the nip. A stationary guide member is interposed between the retard member and the tray. The guide member is adapted to be engaged by the sheet to guide the sheet toward the nip. A thin, flexible member has one end thereof secured to the guide member with the other end being free. The free end extends into the nip to shield the sheet from the retard member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
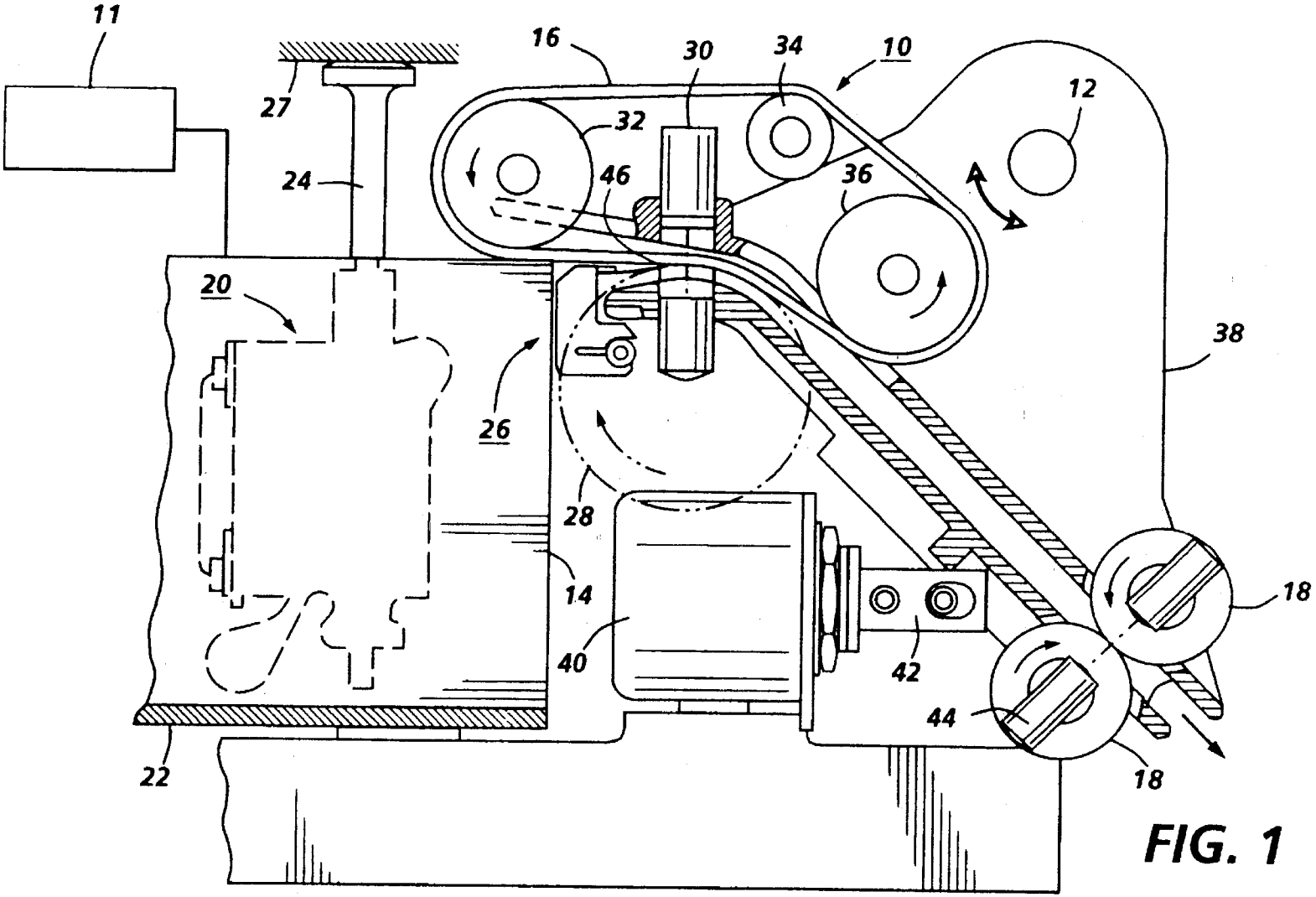
FIG. 1 is a schematic elevational view showing the guide member of the present invention used in a sheet feeding and separating apparatus.

For a general understanding of the features of the present invention, reference is made to the drawings. In the drawings, like reference numerals have been used throughout to identify identical elements. FIG. 1 schematically depicts an illustrative sheet separating and advancing apparatus adapted to be used in a copying or printing machine.

Referring now to FIG. 1, there is shown the sheet feeding apparatus of the present invention adapted to be used in an electrophotographic printing machine 11. A sheet feeding apparatus of this general type described in U.S. Pat. No. 4,494,744 and is hereby incorporated into the present application by reference thereto. As shown in FIG. 1, a feed head mechanism 10 pivots about pivot rod 12. A dynamic normal force is applied to a stack of sheets 14 by endless belt 16 due to the feed head being balanced about pivot rod 12 and the effect of the drive torques furnished to the feed head through the pivot rod. Belt drives (not shown) transfer power to belt 16 and take-away rollers 18. An initial normal force is placed on the stack of sheets 14 by belt 16 with the normal force being controlled by stack height sensor 20. This allows a wide range of settings within a tight span without tending to induce binding of the belt. Sensor 20 in conjunction with stack force relief sensor 22 combines to provide feed head 10 with automatic stack force adjustments. When a stack of sheets is inserted into tray 22 and the access door is closed, a motor (not shown) is actuated to raise the stack of sheets 14 supported on tray 22 mounted on an elevator (not shown) until plunger 24 of photosensor 20 contacts abutment 27. The sensor is adjusted such that the normal force of the idler and belt against stack 14 is 0.5 pounds when the elevator motor is stopped. This sensor works in conjunction with a stack force relief mechanism to provide an automatic two-step system of normal force adjustment for the friction retard feeders. The normal force between the feeding component and the stack is a critical parameter. If the normal force is too large, multiple feeding will occur. If the normal force is too small, misfeeding will occur. In some feeders of this type, a sheet or sometimes a group of sheets are fed to a separation station. If groups of sheets are fed, they are shingled by guide member 26. The guide member functions to guide the advancing sheet into the nip defined by retard roll 28 and endless belt 16, and shield the sheet from the retard roll 28. Guide member 26 will be described hereinafter in greater detail with reference to FIGS. 3 and 4. Once the sheets are in the separation station, the stack normal force drive is no longer necessary. At this point, it is advantageous to reduce the stack normal force in order to reduce the tendency to drive a second sheet through the separation station formed between belt 16 and retard roll 28. To achieve this, a sensor 30 senses the presence of the sheet in the separation station and causes the stack normal force to be reduced. While belt 16 and retard roll 28 are shown herein, one skilled in the art will appreciate different feed means, such as rolls, paddle wheels, etc. could be utilized in lieu of belt 16 or in combination with one another. Thus, a dual roll retard nip can be employed with the guide member of the present invention. Belt 16 is entrained about rollers 32, 34 and 36. The rollers are spaced from one another and define a path through which belt 16 moves. Belt 16 is adapted to move in a recirculating path.

In operation, feed head 10, which is mounted pivotably on frame 38, pivots about rod 12. When stack force relief sensor 30 detects the lead edge of a sheet at the retard nip formed between belt 16 and retard roller 28, a machine controller (not shown) actuates solenoid 40 which retracks plunger 42 pivoting feed head 10 about rod 12. This lifts the frame slightly. The stack normal force may be reduced to zero or feed head 10 lifted completely off the stack of sheets. However, for optimum results, the stack normal force is reduced from about 0.5 pounds to about 0.1 pounds. The force in the retard nip will cause the belt to drive the first sheet through the nip and into the take-away rolls 18. Because the stack normal force has been reduced, it should not contribute sufficient drive force on the second sheet to drive it through the nip. This reduces the probability of multi feeds. Conversely, if the stack normal force has been reduced and sensor 30 does not detect a sheet every 0.3 seconds, the controller will deactuate solenoid 40 causing the separator mechanism to resume the original position, thereby increasing the stack normal force to 0.5 pounds in order to feed a sheet from the stack. The term sheet used throughout this application refers to a substrate of any type.

Roller 36 is coupled to a motor and functions to drive belt 16 in a recirculating path. An independent motor rotates one of the rollers 18 to act as a drive roll advancing the other roll in unison therewith. A weight sensor 44 is stationed at the take-away rolls, remote from the retard roll nip. Early feed belt restart logic is used with this independent drive system. The logic restarts the feed belt (after the weight time has elapsed) as soon as there no sheet at the stack normal force relief sensor 30 or as soon as there no sheet at the wait sensor 42, which occurs first. The wait sensor 42 is also used as a jam detector. The sheet feeding apparatus also has a drag break controlled retard roll 28. The retard brake torque and other feed head critical parameters are selected so that with one sheet of paper through the retard nip 46, the retard roll rotates in the feed direction and with two sheets of paper through the retard nip the roll is fixed. When a sheet is present at stack force relief sensor 30, the normal force value is controlled to a low level. When no sheet is present at sensor 30, the normal force value is increased. The high value of the normal force is defined so that the most difficult sheet will feed reliably, i.e. not misfeed. The low value of the normal force is defined so that the lightest weight sheets will not be damaged. As shown in FIG. 1, an elevator moves tray 22 in an upwardly direction to position the uppermost sheet of the stack of sheets 14 in engagement with belt 16 in the region of roller 32. As belt 16 moves, the uppermost sheet is advanced from the stack and guided by guide member 26 into nip 46. Thereafter, the sheet is fed through the nip rollers 18 for forwarding to subsequent processing stations in the printing machine.

Figure 2:
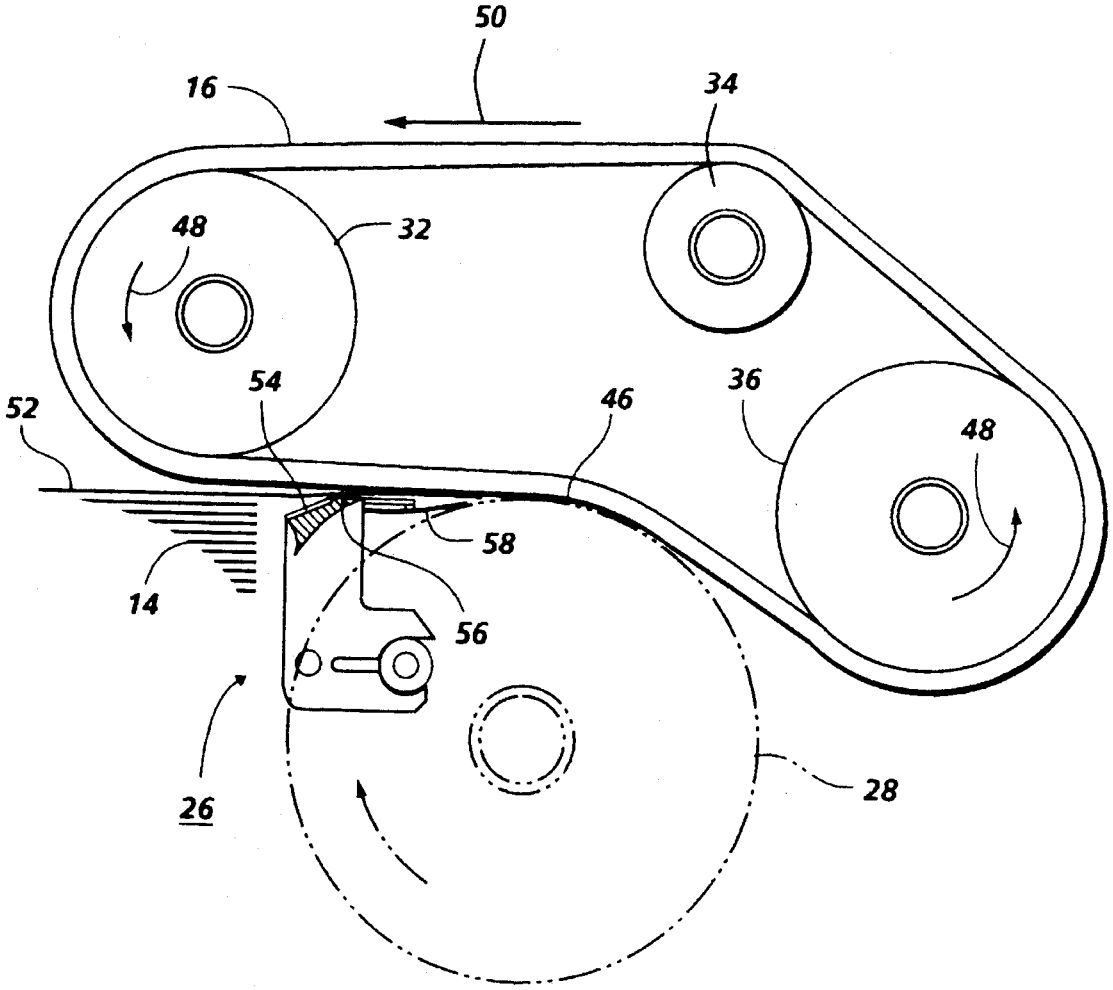
FIG. 2 is an enlarged elevational view showing the guide member and its relationship to the nip defined by the retard roller and endless belt of the FIG. 1 sheet feeding and separating apparatus.

Referring now to FIG. 2, there is shown further details of guide member 26, belt 16 and retard roll 28. Drive roller 36 is driven in the direction of arrow 48 to advance belt 16 in the direction of arrow 50. The uppermost or outermost sheet 52 is positioned in engagement with belt 16 beneath roller 32. As belt 16 moves in the direction of arrow 50, sheet 52 is advanced from stack 14 and engages a polycarbonate portion 54 of guide member 26. The lead edge of the sheet is guided along polycarbonate portion 54 onto a generally planar, high friction urethane portion 56. Thereafter, the lead edge of the sheet continues to move along the urethane portion 56 onto a thin flexible member 58 made preferably from Mylar. Flexible member 58 is supported in a cantilever fashion with end secured to the guide member and the other end being free and extending outwardly therefrom into the nip defined by belt 16 and retard roll 28. In this way, flexible member 58 shields the sheet from the retard roll 28 and guides the sheet into the nip.

Figure 3:
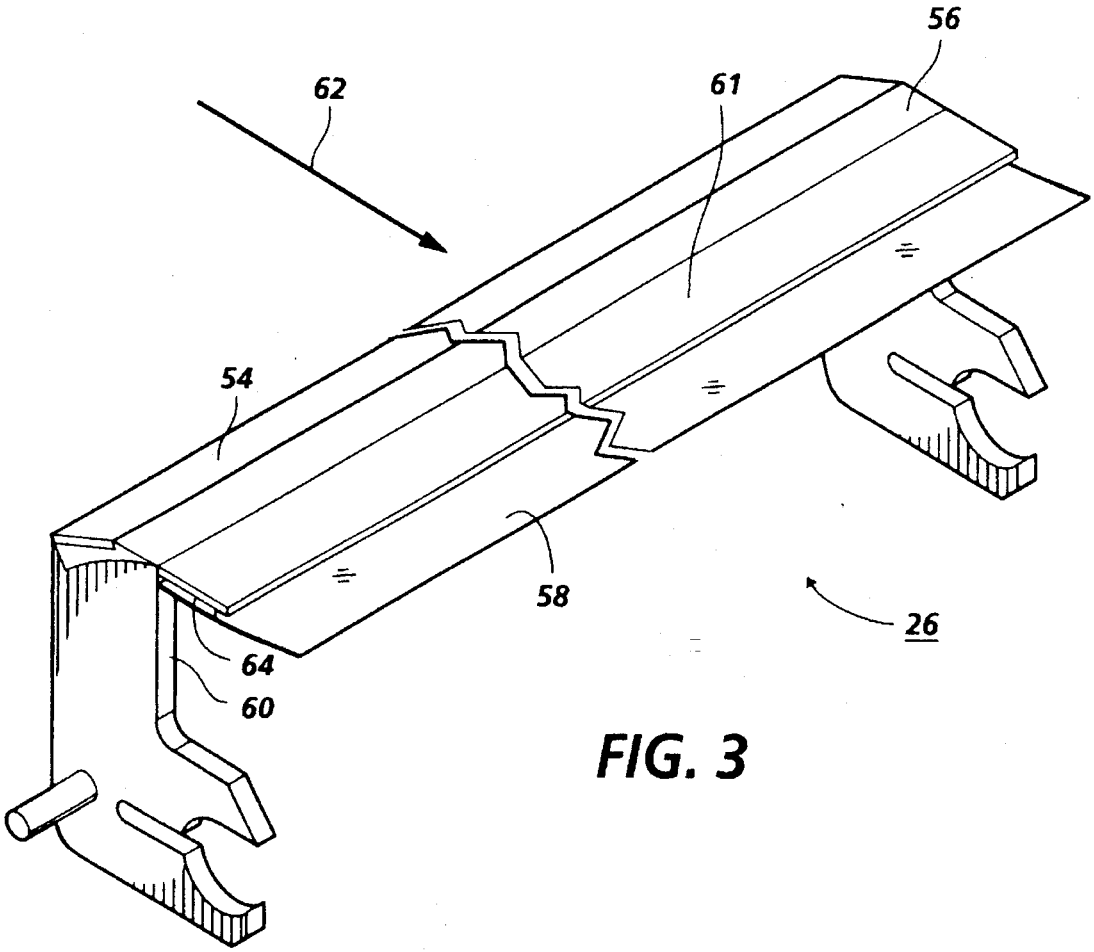
FIG. 3 is a perspective view showing the guide member used in the FIG. 1 sheet feeding and separating apparatus.
Figure 4:
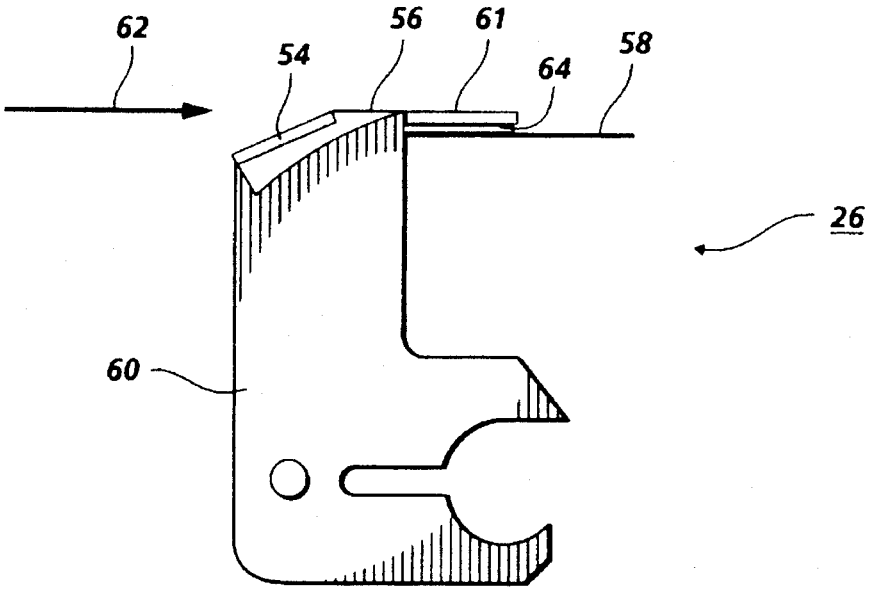
FIG. 4 is an elevational view of the FIG. 3 guide member.

Referring now to FIG. 3 and 4, there is shown guide member 26 in greater detail. As depicted thereat, guide member 26 includes a frame 60 having a generally planar urethane member 56 molded integrally therewith in the upper surface thereof. A generally planar polycarbonate member extends in a transverse direction to the urethane member 56. Polycarbonate member 54 is adjacent urethane member 56 and is also molded integrally with frame 60. Thus, guide member 26 includes a frame 60 having a urethane member 56 and a polycarbonate member 54 molded integrally therewith together to form the entire multi piece guide assembly used in the sheet feeding apparatus.

Flexible member 58 has one end thereof secured to an overhanging portion of urethane member 56 in the region 61 thereof. The other end of flexible member 58 is free and adapted to be positioned in nip 46. Thus, a sheet advancing in the direction of arrow 62 may have the lead edge thereof engage polycarbonate member 54. Polycarbonate member 54 is angled such that that the sheet lead edge moves upwardly onto urethane member 56. Urethane member 56 guides the lead edge of the sheet onto thin, flexible member 58 which, in turn, guides the sheet into the nip 46 defined by belt 16 and retard roll 28. As the thin flexible member guides the sheet into the nip, it simultaneously shields the sheet from the retard roll.

By way of example, thin, flexible member 58 is secured to portion 61 of frame 60 adhesively by, for example, double-backed adhesive tape. Preferably, thin, flexible member 58 is made from a Mylar film having a thickness of 4 mills and projecting a length of 15 millimeters from the end 64 of region 61. In this way, film 58 projects into the nip between belt 16 and retard roll 28 thereby shielding part of the surface which the sheet contacts on retard roll 28. This reduces the level of frictional drag placed on the sheet by the retard roll. Thus, sheets having high levels of toner area coverage which otherwise may be too slippery against belt 16 are reliably fed.

In recapitulation, it is evident that the sheet separating and advancing apparatus of the present invention includes a tray supporting a stack of sheets. An endless belt is mounted in engagement with a sheet of the stack to advance the sheet therefrom. A retard roll engages the endless belt and defines a nip for separating any overlapped sheets. A stationary guide member is interposed between the retard roll and the tray. The guide member is adapted to engage the leading edge of the advancing sheet and guide it toward the nip. A thin, flexible member, preferably made from a Mylar film having one end thereof secured to the guide member with the other end being free and extending into the nip shields the sheet from the retard roll and the associate frictional drag thereof. This enables successful sheet feeding for sheets having high density images formed thereon.

It is, therefore, apparent that there has been provided in accordance with the present invention, a sheet separating and an advancing apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for separating and advancing sheets from a stack of sheets, including:

a tray for supporting the stack of sheets:

an endless belt mounted in engagement with a sheet of the stack of sheets to advance the sheet from the stack of sheets;

a retard member engaging said endless belt to define a nip therebetween for separating any overlap sheets reaching the nip, said retard member including a roll having a curvilinear portion thereof deformably engaging said belt;

a stationary guide member, interposed between said retard member and said tray, and adapted to be engaged by the sheet to guide the sheet toward the nip, said guide member includes an integrally molded, multi-piece guide, said molded guide includes:

a thin flexible film;

a generally planar, high friction urethane portion with said film extending from one end thereof; said having one end secured to said urethane portion with the other end being free and extending into the nip to shield the sheet from said retard member and guide the sheet into the nip; and a polycarbonate portion extending from the other end of said urethane portion and being transverse thereto;

means for supporting and moving said endless belt in a recirculating path; and means for moving the stack of sheets upwardly so as to position the outermost sheet of the stack of sheets in engagement with said endless belt.

2. An apparatus according to claim 1, wherein said film includes Mylar.

3. An apparatus according to claim 2, wherein said film extends about 15 millimeters from said urethane portion.

4. An apparatus according to claim 3, wherein said film is about 4 mils thick.

* * * * *